US006017387A

United States Patent [19]

Hadano et al.

[11] Patent Number: 6,017,387

[45] Date of Patent: Jan. 25, 2000

[54] PROCESS FOR PREPARING MOLDING SAND FOR GREEN SAND MOLD

[75] Inventors: Yutaka Hadano, Hoi-gun; Shigeaki Yamamoto, Toyohashi, both of Japan

[73] Assignee: Sintokogio, Ltd., Nagoya, Japan

[21] Appl. No.: 09/169,165

[22] Filed: Oct. 8, 1998

[30] Foreign Application Priority Data

Oct. 9, 1997 [JP] Japan ..... 9-293353

[51] Int. Cl.[7] ..... B28B 7/34; B22C 1/18; B22C 9/02

[52] U.S. Cl. ..... 106/38.9; 106/38.27; 106/38.3; 106/482; 106/485; 106/486; 164/349

[58] Field of Search ..... 106/38.27, 38.9, 106/38.3, 482, 485, 486; 164/349

[56] References Cited

U.S. PATENT DOCUMENTS

| | | | |
|---|---|---|---|
| 3,961,967 | 6/1976 | Brooks | 106/38.23 |
| 4,529,028 | 7/1985 | Dybala et al. | 164/369 |
| 4,620,586 | 11/1986 | Musschoot | 164/253 |
| 5,587,008 | 12/1996 | LaFay et al. | 106/38.51 |

FOREIGN PATENT DOCUMENTS

| | | | |
|---|---|---|---|
| 736 349 A2 | 10/1996 | European Pat. Off. | B22C 5/08 |
| 10-263744 | 10/1998 | Japan | B22C 9/00 |

OTHER PUBLICATIONS

Radhakrishnan et al., Effect of Water–Clay Ratio and Bentonite Content on the Flowability of Synthetic Sands, *BR Foundryman*, Aug. 1975, vol. 68, No. Part 8, Aug. 1975, pp. 202–208, XP–002091487.

Subba Rao V V et al., Effect of Clay–Water Ratio and Clay Content on the Physical Properties of Bentonite Bonded Homogeneous Sand Mixtures, *BR Foundryman*, Mar. 1976, vol. 69, No. Part 3, Mar. 1976, pp. 71–77, XP–002091488.

Hofmann et al., Statistical Evaluation of 200 Different Foundry Sands, *American Foundryman's Society Transactions*, vol. 80, No. 8, 1980, pp. 177–186, XP–002091489. [No Date].

Effect of Water in Green Sand Mixtures, *Modern Casting*, vol. 72, No. 7, Jul. 1982, p. 44, XP–002091490.

Blatz, J., Cooling of Moulding Sand Under Vacuum, *Foundry Trade Journal*, vol. 166, No. 3447, Feb. 7, 1992, p. 64, XP–000249509.

*Primary Examiner*—Anthony Green
*Attorney, Agent, or Firm*—Limbach & Limbach L.L.P.

[57] ABSTRACT

A process for preparing a molding sand for a green sand mold is provided. The process comprises the step of drying under a reduced pressure of 0 to 0.3 atm for 0.5 to 30 seconds a green molding sand obtained by kneading silica sand, clay, and water, to dry the clay superficial part and to retain in a moist state the clay deeper part on the silica sand core part in each particle of the molding sand. The molding sand prepared by this process has enhanced flowability. Furthermore, the sand mold prepared from the molding sand has sufficient strength.

5 Claims, 1 Drawing Sheet

PROCESS FOR PREPARING MOLDING SAND FOR GREEN SAND MOLD

FIELD OF INVENTION

The present invention relates to molding sand for a green sand mold having an excellent flowability and an excellent ability for binding, that is, one which is used for making a sand mold for casting a cast, and a process for preparing the molding sand.

BACKGROUND OF INVENTION

The important properties that molding sands for green sand molds should generally have are that by using the molding sands the green sand molds can be readily formed, and that molten metals having a high temperature can be satisfactorily poured into the green sand molds that have been prepared by using the molding sands without the molten metals being disadvantageously affected. The former is a property that is described as a moldability of molding sands at ordinary temperatures. On the other hand, the latter is a property of molding sands at high temperatures.

To make a mold, first a molding sand must be adapted to a pattern to exactly copy it. Then, after the mold is made, the pattern is drawn out from the mold. Also after the pattern is drawn out, the sand mold must keep its shape, and must resist the pressure, impact, etc. from a molten metal. To satisfy these requirements, the molding sand must have an excellent flowability, and ability for binding sand particles with each other. However, generally, the flowability of the molding sand and the property in which sand particles are bound together (i.e., the ability for binding) are incompatible.

Conventionally, to simultaneously obtain both properties that are generally incompatible, a high-quality clay has often been used that has high mold cramping force even with a low water content, and as an aggregate a silica sand, the particles of which are uniformly shaped and roundish, has often been used due to its having good flowability. However, the high-quality clay and the uniformly shaped and roundish silica sand particles have become increasingly expensive year by year due to the apprehension regarding the exhaustion of such resources. Therefore, the artisan has coped with this situation by making much of any one of the two properties that are incompatible, instead of using both the high-quality clay and the uniformly shaped and roundish silica sand particles. That is, based on the recognition that the flowability and the ability for binding that have been demanded for molding sands are generally incompatible, an artisan seeks the best condition of the molding sand depending on the use of the green sand mold by altering the strength of one of the properties. Further, for maintaining the conditions of the molding sand, many efforts are made by using the five senses to adjust the sand temperature, water content, temperature, humidity, etc. However, in many cases, artisans are not satisfied with the quality of the molding sand.

The present inventors have investigated clay and silica sand. As a result, they have recognized that there are abundant resources of clay and silica sand that can be used and inexpensively obtained, provided that the molding sands obtained from the clay and silica sand, the resources of which are abundantly present, can manifest satisfactory flowability.

Thus, the object of the present invention is to provide a molding sand having a suitable flowability necessary for giving a high moldability and an ability for binding necessary for giving a satisfactory mold strength after sand molds are made, and a process for preparing the molding sand.

SUMMARY OF INVENTION

The present inventors have extensively investigated the flowability and the ability for binding that are required for molding sand. As a result, they have recognized that the flowability is required in the step of adapting the molding sand to a pattern, and that the ability for binding is required in the subsequent steps and after sand molds are molded. They have also recognized that the flowability can be obtained if the superficial part of an outer layer of a sand particle comprised of clay and water is dry, and that the ability for binding after the mold is made, in other words, the mold strength, can be obtained if the deeper part of the outer layer is moist. Based on this recognition, they have studied to find a process for preparing a molding sand that meets these necessary conditions. When they have studied, they have directed their attention to the fact that during the kneading of silica sand, clay, and water to make a green molding sand, to cool the contents in the kneading vessel the pressure in it is reduced so as to be in a vacuum state, thereby allowing the water contained in the green molding sand to evaporate. Based on this fact, they have considered that if the kneaded green molding sand is vacuum dried for a predetermined period of time, the superficial part of the outer layer (i.e., the clay layer) of the green molding sand is dried because of the evaporation of the water contained in that part, but the deeper part of the outer layer remains moist. The present inventions have been completed based on these findings.

Thus, the present invention provides molding sand particles comprising silica sand, clay, and water, the core part of which is essentially constituted by silica sand, and the outer layer of which comprises clay and water, characterized in that the superficial part of the outer layer is dry, and the deeper part of the outer layer is moist.

Further, the present invention provides a process for preparing a molding sand for a green sand mold, characterized by comprising the steps of producing particles of green molding sand by kneading silica sand, clay, and water, each particle being provided with a core part that is essentially constituted by silica sand and an outer layer that comprises clay and water, the outer layer comprising a superficial part and a deeper part, and drying said green molding sand under a reduced pressure of 0 to 0.3 atm for 0.5 to 30 seconds to dry said superficial part and to retain said deeper part in a moist state.

The step of said drying may be carried out in a tank for transporting said green molding sand to a hopper by air, or in a sand holder of a molding-sand-blown-in type molding apparatus.

Although U.S. Pat. No. 4,620,586 discloses that to reclaim foundry sand, hot wet foundry sand is exposed to a reduced pressure, the object of carrying out the step using the reduced pressure differs from that of the vacuum drying step of the present invention.

DETAILED DESCRIPTION OF INVENTION

Figure 1:
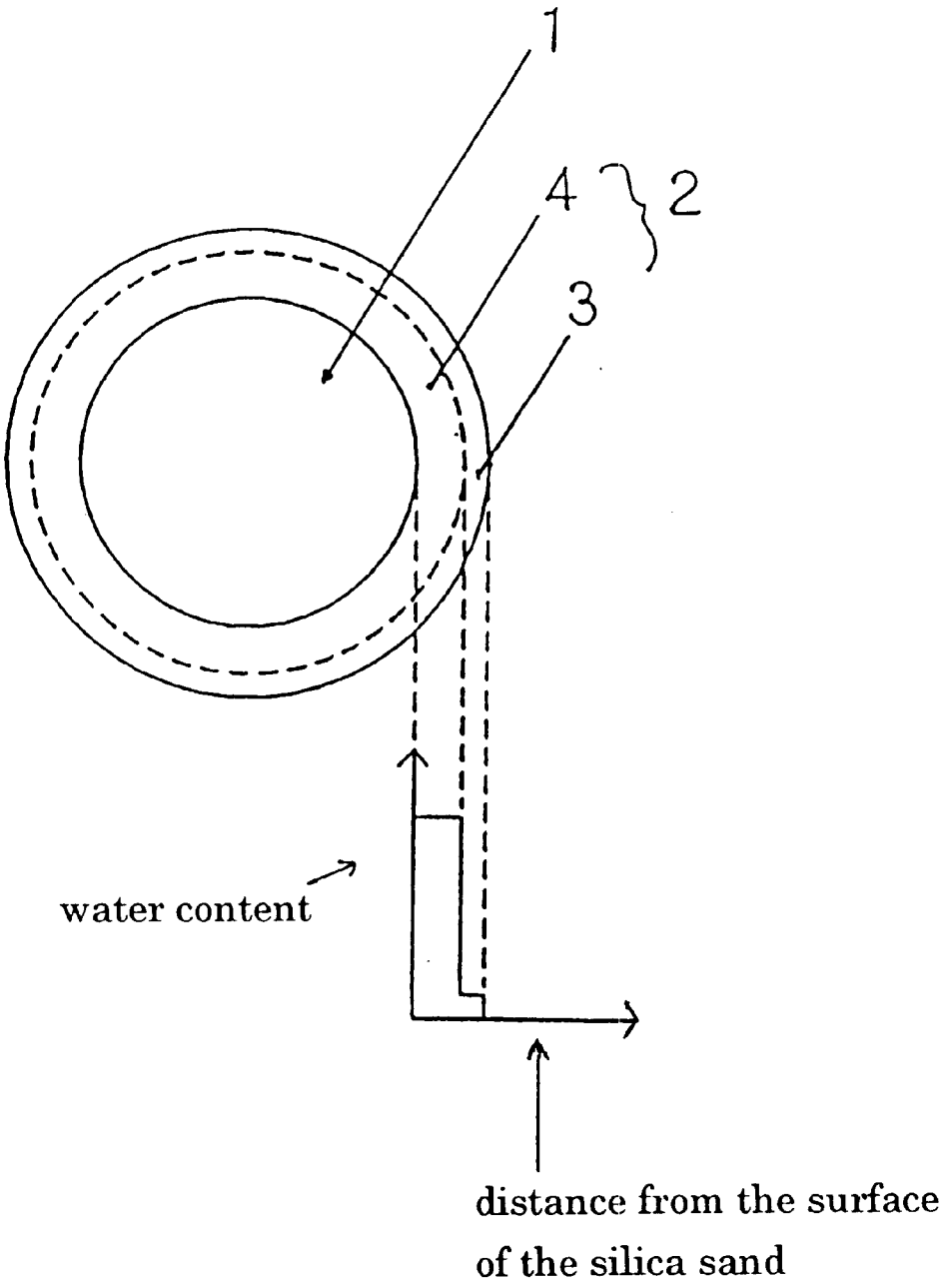
FIG. 1 is an artificial view showing the water content distribution in the particle of the molding sand of the present invention.

A preferable embodiment of the present invention will be explained in detail.

The green molding sand before vacuum drying can be prepared by any usual method under usual conditions. The molding sand comprises silica sand, clay, and water, and may further comprise optional components such as additives usually used for the molding sand. The silica sand may be those (e.g., Flattery silica sand, etc.) which are conventionally used in this field, or those (e.g., river sands) which are abundantly present and inexpensive but are thought to be difficult to readily use for making green sand molds. River sands may have an angular or sub-angular shape. The clay may be those (e.g., Ca-bentonite, etc.) which are conventionally used in this field, or those (e.g., kaolinite, etc.) which are abundantly present and inexpensive but are thought to be difficult to readily use for making green sand molds.

The kneaded green molding sand is vacuum dried under a reduced pressure of 0 to 0.3 atm for 0.5 to 30 seconds. The reduced pressure is preferably from 0 to 0.1 atm. The period of time for vacuum drying is preferably from 0.5 to 1 second. However, the period of time of 5 to 30 seconds is also applicable. These conditions were determined by considering the attainment of the desirable moisture conditions of the molding sand. The period of time for vacuum drying in the present invention was determined also by considering the time cycle of the mold-making process not being affected.

The vacuum drying is preferably carried out in a tank for transporting by air the green molding sand obtained by kneading silica sand, clay, and water, to a hopper. Alternatively, the vacuum drying is preferably carried out in a sand holder of a molding-sand-blown-in type molding apparatus. The vacuum conditions defined in the present invention can be realized in the tank for transporting by air the green molding sand, or in the sand holder. The tank or the sand holder is used in a step after kneading.

FIG. 1 shows an artificial view showing the water content distribution in the particle of the molding sand of the present invention.

From the surface of the outer clay layer 2 of the molding sand particle, free water and water contained in the superficial part 3 evaporate in a short period of time by the vacuum drying of the present invention. Thus, the superficial part 3 of the outer clay layer 2 comes to be dry. Therefore, this molding sand shows an excellent flowability like that of a dried molding sand. The superficial part 3 generally has a water content of about ⅕ of the average water content of the outer layer.

In contrast, the deeper part 4 of the outer clay layer 2 on the silica sand core part 1 keeps the water contained in this part and retains its moist state. Because of the water contained in this deeper part 4, when the molding sand particles are compressed, this part 4 exhibits a bondability to enhance the strength of the sand mold.

As is apparent from the above explanation, since the kneaded green molding sand is dried under a reduced pressure of 0 to 0.3 atm for 0.5 to 30 seconds, the superficial part of the outer layer of the molding sand is dried, but the deeper part of the outer layer of it remains in a moist state. As a result, in the present invention, various silica sands and clays that include those that have been generally thought to be difficult to readily use for making green sand molds can be used as the raw materials. This fact results in remarkable effects.

Further, the step of the present invention does not affect the time cycle of the mold-making process.

EXAMPLES

To show the usefulness and effects of the present invention, below test examples are shown:

1. Method for Preparing Molding Sand

Silica sand, clay, and water are kneaded together by a conventional manner to give samples of a molding sand. The water contents of the samples were controlled to be 3.5% by weight, 4.0% by weight, and 4.5% by weight based on the sum of the silica sand, clay, and water.

The silica sand used here was Flattery silica sand. The Flattery silica sand contained 99.8% of $SiO_2$, 0.03% of $Al_2O_3$, 0.01% of $Fe_2O_3$, less than 0.01% of CaO, and less than 0.01% of MgO. The clay used here was Ca-bentonite.

Then, the molding sand samples of the present invention were subjected to a vacuum drying under a pressure of 0.1 atm for 10 minutes.

2. Test Method for Compactability

The molding sand was put into a cylinder having a height of 100 mm and a diameter of 50 mm through a 6-mesh sieve. The excess molding sand was removed. Then, the molding sand was squeezed at a squeeze pressure of 10 kg/cm$^2$. The reduction, x, of the height of the molding sand in the cylinder by this squeeze was determined.

Since in this case the height of the cylinder was 100 mm, the compactability index (CB value) was calculated according to the formula:

$$\text{CB value } (\%) = \frac{x}{100} \times 100.$$

3. Test Method for Strength of Sand Mold (JIS Z-2604)

Samples prepared according to the method given in JIS Z-2603 were used. Specifically, molding sand was put into a cylinder having a height of 110 to 150 mm and an inner diameter of 50 mm, into which a supporting table had previously been placed. Then, the molding sand was squeezed three times by using a squeezer to give a test sample having a height of 50 mm. The test sample was pushed out from the cylinder. The test sample was installed in a compression tester, and compressed at a speed of about 30 g/cm$^2$/s until the sample was destroyed.

The compression strength was calculated according to the formula:

$$\text{Compression Strength} = \frac{\text{Load (kgf) when the test sample was destroyed}}{\text{Area (cm}^2\text{) of the cross section of the test sample}}.$$

(kgf/cm$^2$)

4. Test Method for Surface Stability Index (Sample) Samples prepared according to the method given in JIS Z-2603 were used.

(Apparatus) A Ro-Tap sieve shaker was used. The sieve had a 6-mesh size. Usually, its rotational speed is 240 rpm, and the radius of rotation is 15 mm.

(Measurement) The sample was put on the 6-mesh sieve. Then, the sieve was set on the shaker, and the shaker was driven for one minute.

(Calculation) The surface stability index was calculated according to the formula:

$$\text{Surface Stability Index} = \frac{\text{Sample weight after shaking}}{\text{Sample weight before shaking}} \times 100.$$

5. Results and Discussion (1) Compactability

Table 1 shows the CB values.

TABLE 1

| Water content % | CB value of control molding sand that is not subjected to vacuum drying | CB value of vacuum dried molding sand of the present invention |
|---|---|---|
| 3.5 | 32 | 28 |
| 4.0 | 35 | 32 |
| 4.5 | 39 | 37 |

The molding sand examples of the present invention show CB values lower than those of the control molding sands.

The molding sand examples of the present invention had more excellent flowability than that of the control molding sands. Therefore, the cylinder was filled with the molding sand example of the present invention closer than the case in which the control molding sand that corresponded to the molding sand example of the present invention was used. As a result, the molding sand example of the present invention contained in the cylinder was squeezed at an extent lesser than the case in which the control molding sand that corresponded to the molding sand example of the present invention was used.

(2) Strength of Sand Mold and Surface Stability Index

Table 2 shows the strengths of the sand molds and the surface stability indexes.

TABLE 2

| | Test piece made with control molding sand that is not subjected to vacuum drying | Test piece made with vacuum dried molding sand of the present invention |
|---|---|---|
| Strength of sand mold | 1.3 kgf/cm$^2$ | 1.3 kgf/cm$^2$ |
| Surface stability index | 91% | 90% |

The test piece, that is, the sand mold, prepared from the sample of the present invention by a compression molding has a strength and a surface stability index equivalent to those of the test piece prepared from the control sample.

What we claim is:

1. Molding sand particles, each of the particles comprising:

a core consisting essentially of silica sand, and an outer layer consisting essentially of clay and water, wherein an outermost part of the outer layer is dry, and a deeper part of the outer layer between the outermost part and the core is moist.

2. The molding sand particles of claim 1, wherein the outer layer of each of the particles has an average moisture content and the outermost part of each said outer layer has a reduced moisture content equal to about 20% of the average moisture content.

3. A process for preparing molding sand for a green sand mold, comprising the steps of:

producing particles of green molding sand by kneading silica sand, clay, and water, so that each of the particles has a core part consisting essentially of silica sand and an outer layer consisting essentially of clay and water, the outer layer comprising an outermost part and a deeper part between the outermost part and the core part, wherein each said deeper part is in a moist state, and drying each of said particles of green molding sand under a reduced pressure of 0 to 0.3 atm for 0.5 to 30 seconds to dry each said outermost part and to retain each said deeper part in the moist state.

4. The process of claim 3, wherein said particles of green molding sand are dried in a tank that is used for transporting by air said particles of green molding sand to a hopper.

5. The process of claim 3, wherein said particles of green molding sand are dried in a sand holder of a molding apparatus.

* * * * *